US006118959A

United States Patent [19]

Michlin

[11] Patent Number: 6,118,959

[45] Date of Patent: Sep. 12, 2000

[54] TONER CARTRIDGE TOOL FOR HOLDING PIN REMOVAL AND IMPROVED HOLDING PIN

[76] Inventor: Steven Bruce Michlin, 5310 Bentley, Suite 105, West Bloomfield, Mich. 48322

[21] Appl. No.: 09/085,780

[22] Filed: May 28, 1998

[51] Int. Cl.[7] ..... G03G 15/00

[52] U.S. Cl. ..... 399/109; 24/711.4; 173/90

[58] Field of Search ..... 399/107, 109, 399/110, 111, 113, 119, 262, 360; 29/270, 275, 278; 173/90; 24/13, 103, 706, 711.4; 411/500, 511

[56] References Cited

U.S. PATENT DOCUMENTS

| | | | |
|---|---|---|---|
| 1,991,561 | 2/1935 | Krantz . | |
| 2,611,168 | 9/1952 | Light . | |
| 3,783,492 | 1/1974 | Duckett et al. . | |
| 3,995,821 | 12/1976 | Einhorn . | |
| 4,016,703 | 4/1977 | Champoux et al. . | |
| 4,040,149 | 8/1977 | Einhorn . | |
| 4,202,242 | 5/1980 | Champoux et al. . | |
| 4,641,412 | 2/1987 | Olger | 29/270 X |
| 4,987,451 | 1/1991 | Hikosaka et al. | 399/119 |
| 5,027,152 | 6/1991 | Oda et al. | 399/111 |
| 5,096,236 | 3/1992 | Thony . | |
| 5,099,562 | 3/1992 | Loughran | 29/275 |
| 5,185,906 | 2/1993 | Brooks . | |
| 5,390,002 | 2/1995 | Michlin | 399/262 X |
| 5,749,027 | 5/1998 | Ikemoto et al. | 299/113 |
| 5,860,778 | 1/1999 | Keener . | |
| 5,875,535 | 3/1999 | Canoy . | |

OTHER PUBLICATIONS

"People & Products", Recharger, Oct. 1997, p. 222.

Michlin, Steven B., "A Solution for Hostile Hopper Holding Pins on Laser Pinter Cartridges", Imaging. News, vol. 5, issue 5–7, Spring 1998, pp. 38–40.

*Primary Examiner*—Sandra Brase

[57] ABSTRACT

An easily removable and reusable improved holding pin device and method for securing together the sections of a toner cartridge assembly for use in imaging machines. The holding pin comprises a shank with a tapered head structured to allow easy gripping of the holding pin by pulling tools by using the taper which forms a recess in the head so the head will abut for easy grabbing with a conventional pulling tool for easy removal. The gripping parts of a tool may extend through this recess space to grip or otherwise contact the head of the holding pin, allowing the holding pin to be pulled from the assembly without damage to the holding pin or cartridge assembly. In another embodiment of the holding pin there is a first portion of the head that is tapered and a second portion of the head that is not tapered so that the tapered portion forms a recess so the second portion is easy to grab and is also set in precise position so as not to stick out too far. In another embodiment of the holding pin there are three portions. The first portion is greater in diameter than bore and the shank to set the position, a second portion is smaller in diameter than the first portion to abut the third portion which is larger in diameter than the second portion so the holding pin is easy to grip for removal and the first and second portions recess the third portion for easy grabbing for removal with conventional pulling tools. Also a tool has been developed for holding pin removal for difficult to remove holding pins that must be pushed out from the inside toward the outside. The tool has a handle and a base. The base may be perpendicular or nearly perpendicular to the handle and have two ends that are like hammerheads and a press-fit pin is positioned at each end and is used to remove the difficult to remove holding pins by pounding the holding-pins out. When pounding out holding pins, the laser light slot may be used as a guide for straight and consistent holding pin removal. Also, when pounding out holding pins, the wiper blade metal frame corner crevice may be used as a guide for straight and consistent and flawless holding pin removal.

20 Claims, 7 Drawing Sheets

TONER CARTRIDGE TOOL FOR HOLDING PIN REMOVAL AND IMPROVED HOLDING PIN

BACKGROUND OF THE INVENTION

This invention relates to solving problems in Xerography and more specifically in the toner cartridge remanufacturing industry. This includes copiers, laser printers and facsimile machines which will be referred to as imaging machines.

CANON has designed an all-in-one cartridge as seen in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1993. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "Optiva" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM (Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartridges with longer cycles, so component improvements are significant. Therefore, avoiding natural problems with prevention means must also be implemented for cartridges of longer life both in longer cycle times and greater number of cycles. One good example is the holding pin used in the LX, FX, FUJI-XEROX XP5/10, LASERJET 5L, LASERJET 4000, LASERJET 5000 and BX CANON engine cartridge. Most may be seen under other nameplates, such as HP, QMS, PITNEY-BOWES-Bowes, CANON FAX and so on, however most engines are manufactured by CANON.

The holding pin is used to hold the main cartridge components together. The holding pin used by the OEM manufacturer has an even diameter all the way around. To remanufacture the cartridge, this holding pin must be removed. Holding pin removal is among the very first steps. Holding pin removal, however, has been an industry-wide problem. Holding pin removal is not always clean. The reason it is not always a "clean" operation is because a very small portion of the holding pin sticks out. Such a small portion protrudes for 2 possible reasons. First, if it sticks out too far, the cartridge will not fit into the imaging machine. So it must be pushed in to a certain depth such that a maximum protrusion is allowed. Some remanufacturers have developed depth setting devices to avoid pushing the holding pin in too far. Others have used standard tools for holding pin pulling. For example wire cutters of the nipper variety, "dikes" and flat wire cutters have been modified on a grinding wheel to pull these holding pins. Even with the best holding pin depth setter, the holding pin must be pulled on the first cycle. In the first cycle, the holding pin is usually pushed in further than desired. When the holding pin is successfully removed, it is generally scratched with score marks from the holding pin-removal process. Once the outer surface of the holding pin is scored, it becomes that much more difficult to remove. The wire cutters have no smooth surface to grab on to. Oftentimes, on the first cartridge cycle, the holding pin is so difficult to remove that the plastic cartridge case must be slightly modified or cut up, drilled, or otherwise deformed in order to remove it. Oftentimes, the holding pin is accidently pushed in too far after the first recharge cycle. In modifying the cartridge, the cartridge loses its factory-new look and usually even looks sloppy and unprofessional as well. In any event, the holding pin makes recharging these cartridge types a project rather than a straightforward task. With the easily removable holding pin device of this invention, holding pin removal is very easy to do.

Inventor was awarded U.S. Pat. No. 5,390,002, issued on Feb. 14, 1995, on an easy pull holding pin. At the time inventor had applied for that patent, only a small percentage of toner cartridges needed the improved holding pin. This is because most toner cartridges at that time used a case for holding the waste toner hopper in position with respect to the toner hopper. This plastic molded case was expensive and eventually, the OEMs realized that they can save money by using a holding pin.

In the LX, 5L and BX toner cartridges, the holding pin protruded just a little bit, enough that a high percentage of toner cartridges could be disassembled without scratching up the plastic. However, when the HP 4000 came out and later the HP 5000, the OEM holding pin was totally embedded in the waste toner hopper. Means were implemented by the OEM that the holding pin could not be pulled out with nothing sticking out and could not be pushed in. This required a device or means of removal of the holding pins from the inside out. Thus, a tool was developed to remove the holding pin from the HP 4000 toner cartridge.

SUMMARY OF THE INVENTION

Accordingly, it is an object of this invention to provide an easily removable holding pin for use in securing toner cartridge assembly sections together.

Another object of this invention is to provide a holding pin with a head designed to be easily gripped so the holding pin may be quickly and efficiently removed from the assembly by typical holding pin pulling tools used in the cartridge remanufacturing industry.

A further object of this invention is to provide a holding pin which may be quickly inserted to the proper depth within the toner cartridge assembly.

A still further object of this invention is to provide a holding pin which may be inserted into and removed from the assembly again and again through many remanufacturing cycles without damage to the holding pin or assembly, a holding pin with a recessed head.

A still further object of this invention is a tool for removal of the original OEM holding pins in the H 4000 toner cartridge or other such cartridge where the holding pin is totally embedded into the bore in the toner cartridge leaving nothing to grip, a removal tool where the holding pins are pounded out of the toner cartridge, pounded from the inside outward, a tool which may be designed using pins that stick out to pound out the OEM holding pins.

A still further object of this invention is a tool for removal of the original OEM holding pins that uses the physical geometry of the toner cartridge to guide the tool to hit the holding pins accurately.

A still further object of this invention is a tool for removal of the original OEM holding pins that uses the laser light slot as a guide for sliding the tool so that the tool accurately hits the holding pins.

A still further object of this invention is a tool and method for removal of the original OEM holding pins that uses the wiper blade's metal frame, a frame shaped like angle iron, as a guide for sliding the tool so that the tool may be slid along the inner corner or crevice of the angle iron to accurately hits the holding pins for holding pin removal.

In carrying out this invention in the illustrative embodiment thereof, a holding pin is disclosed which has a shank and a head designed to be easily gripped by a conventional pulling tool such as pliers, needle nose pliers, nippers, dikes (wire cutters), other form of pliers, or other tool. The head has a taper so as to form a recess for easy holding pin removal. With the tapered or conical head, the holding pin may be easily gripped with a needle nose pliers or other pulling tool for quick and easy holding pin removal.

BRIEF DESCRIPTION OF THE DRAWINGS

This invention, together with other objects, features, aspects, and advantages thereof, will be more clearly understood from the following description, considered in conjunction with the accompanying drawings.

COMPLETE DESCRIPTION OF THE PREFERRED EMBODIMENT

Figure 1:
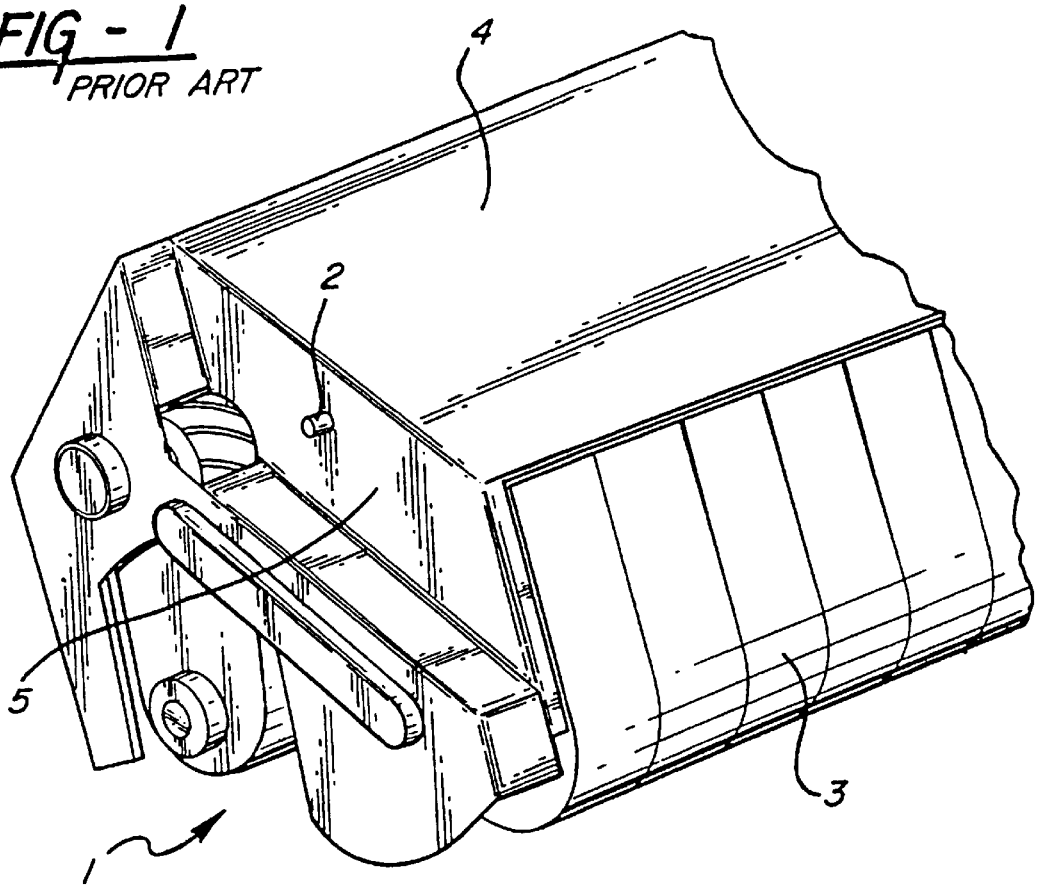
FIG - 1 PRIOR ART
FIG. 1 shows part of a conventional toner cartridge assembly with sections held together by a holding pin.

FIG. 1 shows a conventional toner cartridge assembly 1. When remanufacturing the assembly 1 so it may be used again after the original supply of toner is used up, the toner cartridge assembly 1 needs to be taken apart for the purposes of refilling the toner hopper and replacing worn or broken parts. A holding pin 2 at each end of the assembly 1 holds or secures two sections of the toner cartridge assembly 1 together. A first section 3 includes among its components the toner hopper. A second section 4 includes the photoreceptor drum and waste toner hopper.

Figure 2:
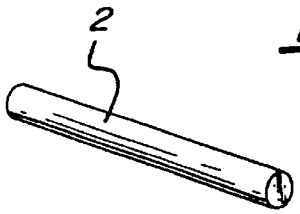
FIG - 2 PRIOR ART
FIG. 2 illustrates a prior art holding pin.

The prior art holding pin 2 is shown more completely (and slightly enlarged) in FIG. 2. The holding pin 2 is difficult to remove from the assembly 1. When it is removed by wire cutters, for example, it is usually scratched or otherwise deformed. Sometimes the plastic cartridge case assembly wall 5 of the assembly section 4 in the area surrounding the holding pin 2 is also damaged. This makes subsequent removal of the holding pin 2 for repeated toner cartridge assembly 1 refillings and remanufacturings more difficult and makes the assembly 1 look sloppy and scratched-up. Additionally, when the holding pin 2 is reinserted into the toner cartridge assembly 1 to hold the sections 3 and 4 together, it must be reinserted to such a depth so the holding pin 2 doesn't stick out too far and prevent the toner cartridge assembly 1 from fitting in the imaging machine. But the holding pin 2 must not be inserted so far into the assembly 1 that the holding pin 2 cannot be removed again. The same problems occur at each end of the toner cartridge assembly 1.

Figure 3:
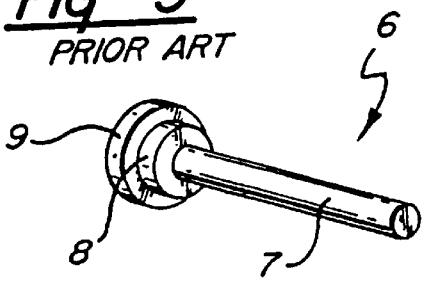
FIG - 3 PRIOR ART
FIG. 3 shows a prior art holding pin of inventor's previous invention.

The prior art holding pin 6 of this inventor's U.S. Pat. No. 5,390,002 is shown (enlarged for clarity) in FIG. 3. The holding pin 6 has a shank 7 with a diameter and length sized to fit in the aligned passage of the first section 3 and second section 4 of the toner cartridge assembly 1 when the sections are put together. The holding pin 6 has a head comprising two portions. The first head portion 8 has a width or diameter larger than the shank 7 and is sized to abut against the wall 5 of the assembly section 4 when the shank 7 of the holding pin 6 is installed in the toner cartridge assembly 1. The second head portion 9 of the holding pin 6 has a width or diameter larger than the diameters or widths the first head portion 8 and the shank 7 of the holding pin 6. The first head portion 8 is located between the second head portion 9 and the shank 7. The head portions 8 and 9 are short in length so the head of the holding pin 6 does not interfere with fitting the toner cartridge assembly 1 into the imaging machine. The holding pin 6 is made of a strong, rigid metal or plastic.

Figure 4:
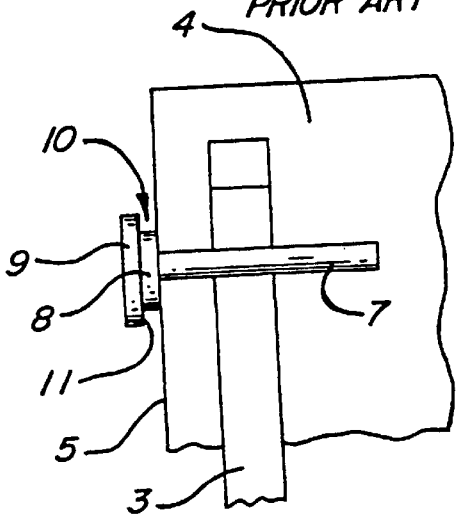
FIG - 4 PRIOR ART
FIG. 4 illustrates how the holding pin of inventor's prior invention is designed for easy removal from and insertion into the toner cartridge assembly in cutaway view.

As shown in FIG. 4, when the prior art holding pin 6 is used to secure the two sections 3 and 4 of the toner cartridge assesmbly 1 together, the shank 7 is inserted completely into the assembly 1 such that the first head portion 8 of the holding pin 6 abuts against the wall 5 of the assembly section 4. This allows the holding pin 6 to be inserted to the exact desired depth needed to both secure the two sections 3 and 4 of the assembly 1 together and prevent the protruding head of the holding pin from interfering with fitting the cartridge assembly in the imaging machine.

Because the second head portion 9 of the holding pin 6 is larger in width or diameter than the first head portion 8, the second head portion 9 overhangs the first head portion 8, providing a space 10 between the second head portion 9 and the wall 5 of the assembly section 4. Therefore, a conventional gripping tool, such as a nipper tool or wire cutter, may be used to fit against the underside 11 of the second head portion 9 and easily pull the holding pin 6 from the assembly 1. In this way, the holding pin 6 may be easily and repeatedly inserted into or removed from the toner cartridge assembly 1 without damage to the holding pin 6 or the assembly 1. A holding pin 6 would be used at each end of the toner cartridge assembly 1.

Figure 5:
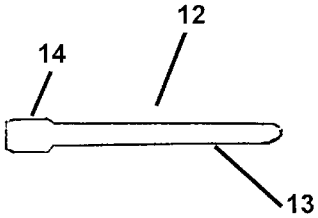
Figure 5 PRIOR ART
FIG. 5 shows an OEM holding pin that is embedded in a bore in the waste toner hopper.
Figure 6:
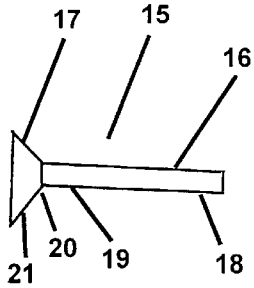
FIG. 6 shows an improved holding pin using a tapered head from the side view.
Figure 7:
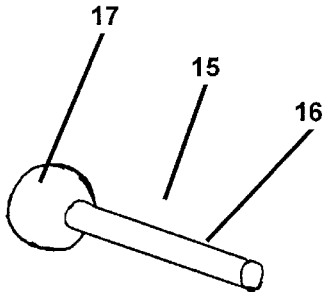
FIG. 7 shows an isometric view of an improved holding pin using a tapered head.

When HP introduced the HP LASERJET 4000, a new technique was introduced by the OEM of not only embedding a holding pin 12 shown in FIG. 5, to make the holding pin 12 difficult to remove, but also a head 14 was introduced on this holding pin 12 by the OEM for the first time. However, the head 14 was not introduced to make the holding pin 12 easier to remove, but was introduced for the opposite reason since the holding pin 12 is also completely embedded inside the waste toner hopper. By putting a head 14 on the holding pin 12 and installing the holding pin 12 in a double bored hole, the holding pin 12 can not be removed by pushing it all the way through to the inside of the toner cartridge. So, the only way to remove this difficult holding pin 12 is to push the shank 13 of the holding pin 12 outward from the inside of the toner cartridge. This may be done by first removing the photoreceptor drum where the remanufacturer can actually see inside the toner cartridge (which can damage the photoreceptor drum) or alternately find a way to push out the holding pin 12 with a tool.

Once the OEM holding pin 12 is removed, no matter how it is removed, and the toner cartridge is reassembled, it is advantageous to replace the holding pin 12 with an improved holding pin with a recessed head. For example, a version of the holding pin 6 (FIG. 3) may be used. However, more improved holding pins have been developed as shown in FIG. 6 through FIG. 9. The holding pin 15 of FIGS. 6–7 has a tapered head. This holding pin 15 has a shank 16 and a head 17. The shank 16 has a left side 19 and a right side 18. The head 17 has a left side 21 and a right side 20. The right side 20 is larger in diameter than the bore so that the holding pin fits in as shown in FIG. 10 yet the left side 21 of the head 17 sticks out so it can be easily removed with a needle nose pliers or other such pulling tool.

Figure 8:
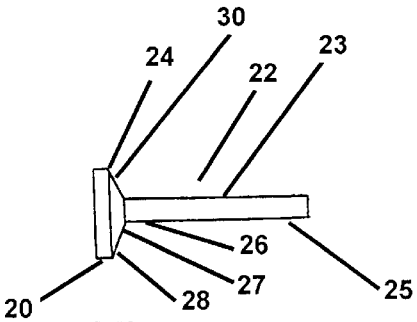
FIG. 8 shows an improved holding pin using a tapered head from the side view.
Figure 9:
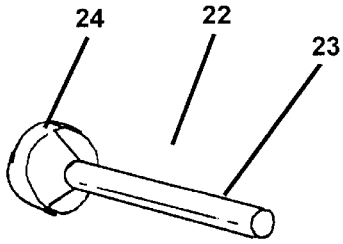
FIG. 9 shows an isometric view of an improved holding pin using a tapered head.
Figure 10:
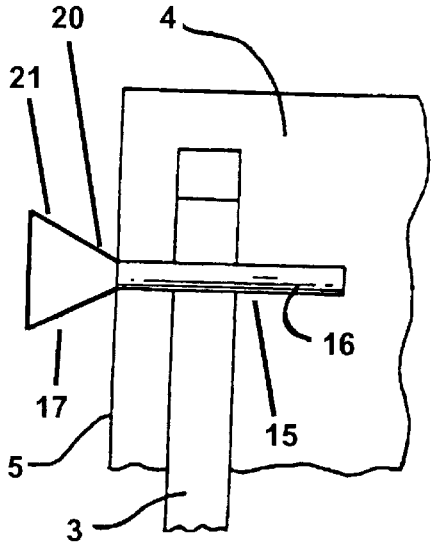
FIG. 10 illustrates how the holding pin of invention is designed for easy removal from and insertion into the toner cartridge assembly in cutaway view.
Figure 11:
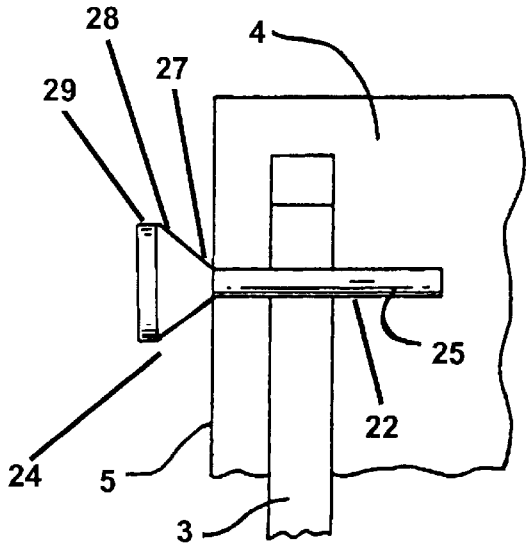
FIG. 11 illustrates how the holding pin of invention is designed for easy removal from and insertion into the toner cartridge assembly in cutaway view.

FIGS. 8, 9 and 11 show another holding pin 22. The holding pin 22 has a shank 23 with a left side 26 and a right side 25. The holding pin 22 has a head 24 with a tapered portion 30 and this tapered portion 30 has a right side 27 and a left side 28. The holding pin 22 has a head 24 with a nontapered easy pull portion 20. As seen in FIG. 1 the holding pin 22 is easy to pull because the head 24 has a tapered portion 30 which is too large to fit in the bore causing the head 24 to abut from the plastic cartridge assembly wall 5 for a predetermined design distance for easy grabbing. The holding pin 15 could be too sharp, so when the sharp corners are rounded, the results could be the holding pin 22, although the roundness is not shown in the figure.

Figure 12:
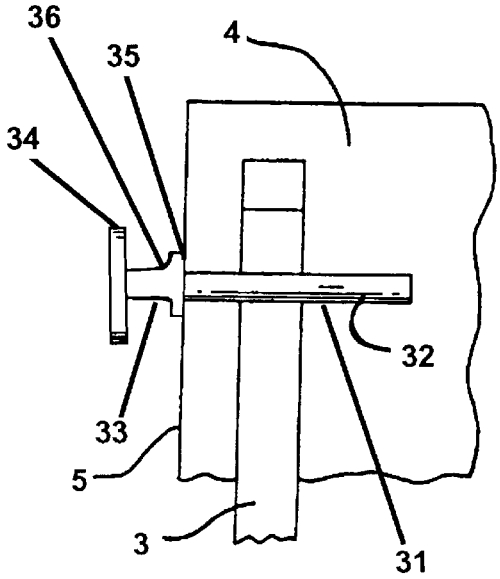
FIG. 12 illustrates how the holding pin of invention is designed for easy removal from and insertion into the toner cartridge assembly in cutaway view.

FIG. 12 shows a holding pin 31 with a shank 32 and a head 33, the head 33 having three portions. The three portions consist of the right side 35 of larger diameter than the shank 32 and bore so the holding pin 31 can only push in to a design depth, a middle section 36, and a left portion 34 of which the purpose is to provide an easy place to grab 34 with a needle nose pliers or other such tool, conventional or nonconventional. The middle section 33 can be smaller in diameter than the shank 32 but can also be larger than the shank 32.

All the above holding pins 12, 15 and 31 abut from the plastic cartridge assembly wall 5 for easy grabbing and have a head of larger diameter than the bore diameter of the cartridge assembly wall 5 to set the holding pin depth so that the holding pin won't push in too deep. Although I have defined these holding pins 12, 15 and 31 as having one head, they may also be interpreted as having multiple heads, but the clearance is typically very small, because if the head stuck out too far, the toner cartridge would not physically fit into the printer, so this argument is difficult to make. Also, the heads of holding pins 12, 15 and 31 have a recess in order that the wide portion sticks out for easy pulling. Also, all arguments describing the features of the pin 6 may be incorporated by reference to the pins 12, 15 and 31 except for some of the design characteristics of the head.

Figure 13:
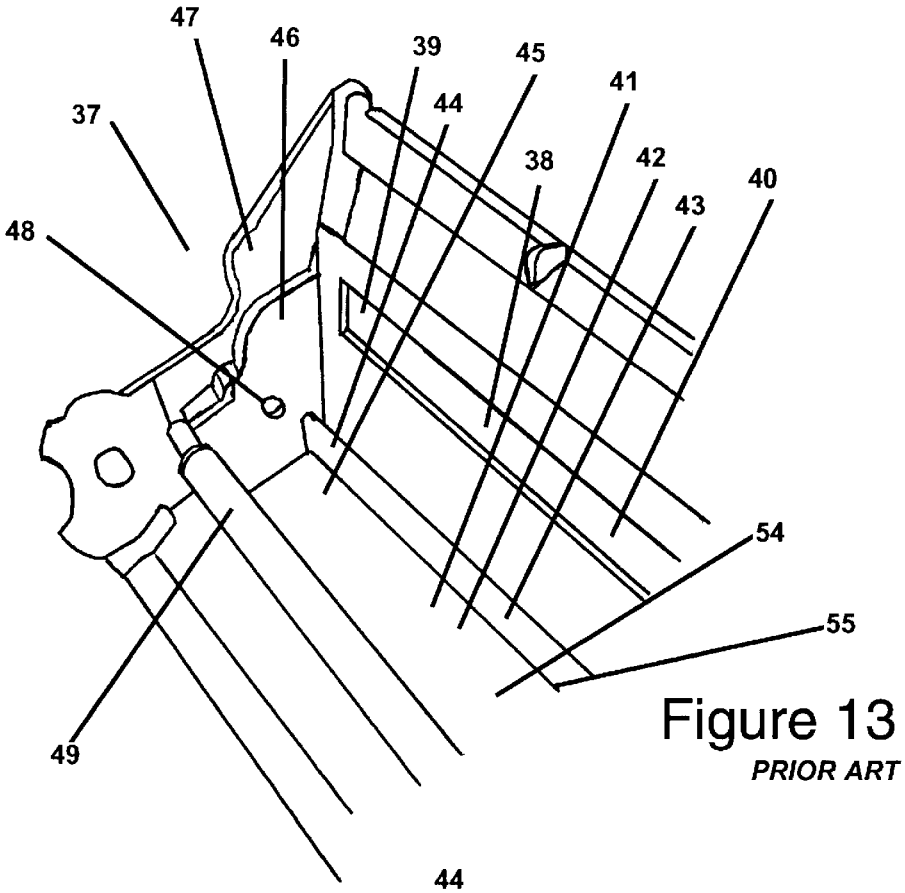
Figure 13 PRIOR ART
FIG. 13 shows an isometric view of inside an HP 4000 waste toner hopper.
Figure 14:
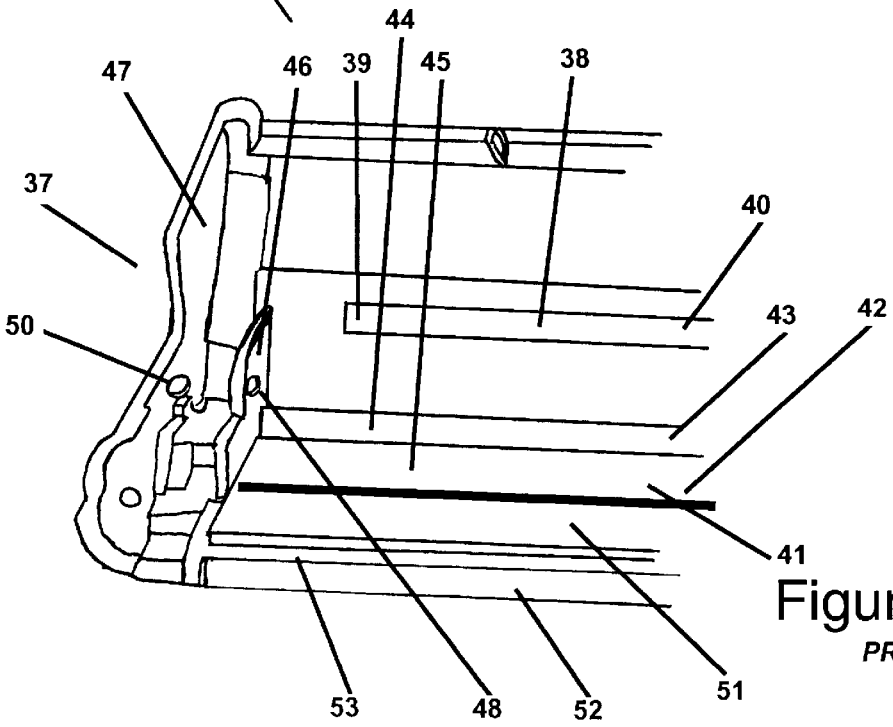
Figure 14 PRIOR ART
FIG. 14 shows an isometric view of inside an HP 4000 waste toner hopper.

FIGS. 13 and 14 show a waste toner hopper 37 of the HP LASERJET 4000 in simplified form, which uses a holding pin 12 that fits through bores 48 and 50 where the holding pin 12 has a head 14 that is also totally embedded in the left bore 50. To remove the holding pin 12 from the inside of the waste toner hopper 37, the only way to get inside is to either remove the photoreceptor (not shown) or to use the laser light slot 38 to enter the waste toner hopper 37 and with a tool to pound the holding pin from the inside toward the outside of the waste toner hopper 37. Also shown in the figures are the primary charge roller 49 or PCR 49, a wiper blade assembly 54 with a metal wiper blade frame 41 or angle iron component 41, the outer pin mount structure 47 with its bore 50, and the inner pin mount structure 46 with its bore 48. The laser light slot 38 has a left side 39 and a middle portion 40. The angle iron component 41 has a bottom 42 and a top 43 that are at an angle to each other. Although the angle is around ninety degrees in the HP 4000, the angle in many other toner cartridges vary to as much as one hundred and twenty degrees or more to give the angle iron component 41 a corner crevice 55, a property natural to a waste toner hopper 37 that has been utilized by the inventor. The top 43 has a left side 44 and bottom portion 42 shows a left side 45.

Figure 15:
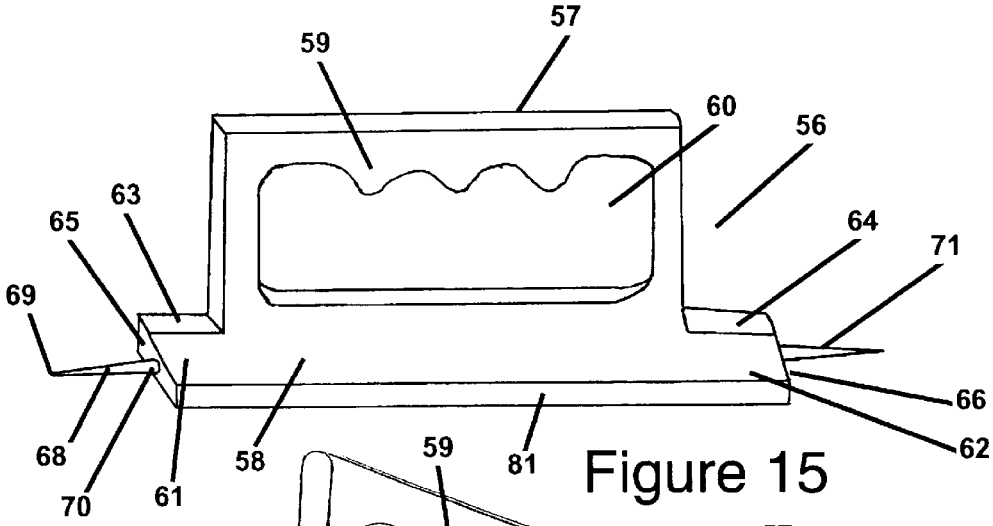
FIG. 15 shows an isometric view of a PinPounder tool for removal of the OEM holding pin from the HP 4000 toner cartridge.
Figure 16:
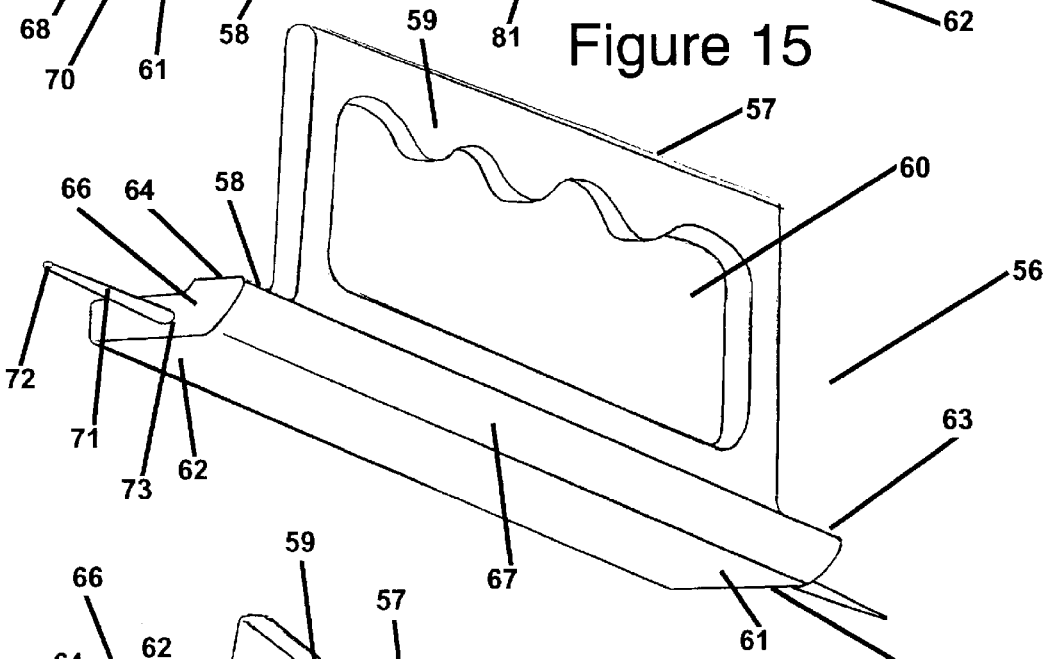
FIG. 16 shows an isometric view of a PinPounder tool for removal of the OEM holding pin from the HP 4000 toner cartridge.
Figure 17:
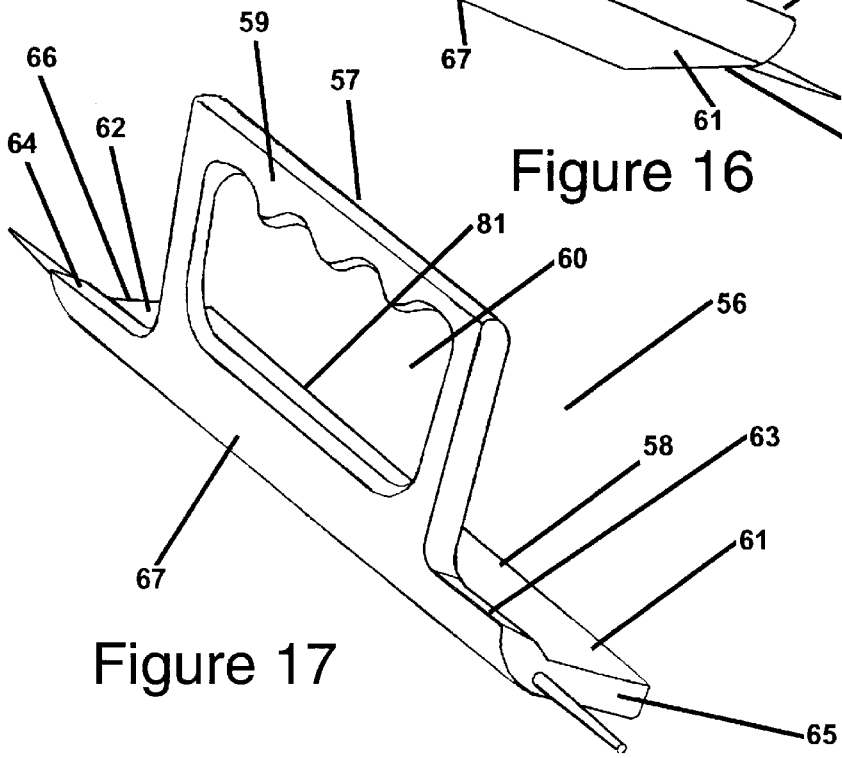
FIG. 17 shows an isometric view of a PinPounder tool for removal of the OEM holding pin from the HP 4000 toner cartridge.

FIGS. 15 through 17 show the Pin Pounder tool 56. The tool 56 has a handle 57 that optionally uses a pistol grip 59 leaving an opening 60 where the hand grips the tool 56. The tool 56 has a base 58 with a left end 65 on the left side 61 and a right end 66 on the right side 62. There is an optional left indentation 63 or bump 63 and a right indentation 64 or bump 64. The bumps 63 and 64 are resultant from the manufacturing process. Optionally, there is a left pin 68 with a join area 70 and a tip 69, as well as a right pin 71 with a join area 73 and a tip 72. Instead of the tool 56 being at a right angle at its outer corner, a bevel curve 67 is machined or otherwise formed into the tool 56. This may also be accomplished by bending flat material, for example, on a press break. The purpose of the bevel is so that the tool 56 will fit into the laser light slot 38. If the thickness of the tool 56 is near the width of the slot 38, then at the hypotenuse (outer corner), the thickness is greater than the slot 38 width which would prevent the tool 56 from fitting into the slot 38 where the tool 56 bends 67. By putting a bevel 67 in the tool 56, the tool width is not greater at this corner (now beveled 67) than the opening available in the slot 38, and thus the tool 56 fits nicely into the waste toner hopper 37. This was discovered early in the design stage.

Although the angle between the handle 57 and base 58 is around 90 degrees in the figures, this angle can vary from around sixty degrees to one hundred and fifty degrees. Also, the pins 68 and 71 are not required to come to a point on the device 56 as shown in the figures, nor are they required to be as long as in the figures. Although any length can be good, a good length for one operating environment has been found to be 5/16 of an inch. Optionally, the pins 68 and 71 may be hardened (as may the entire device 56) so they will never bend out of position and so they will not be cold-worked at the tips 69 and 72, which could cause undesired enlargement at the tips 69 and 72 from continual banging and hammering overtime.

Figure 18:
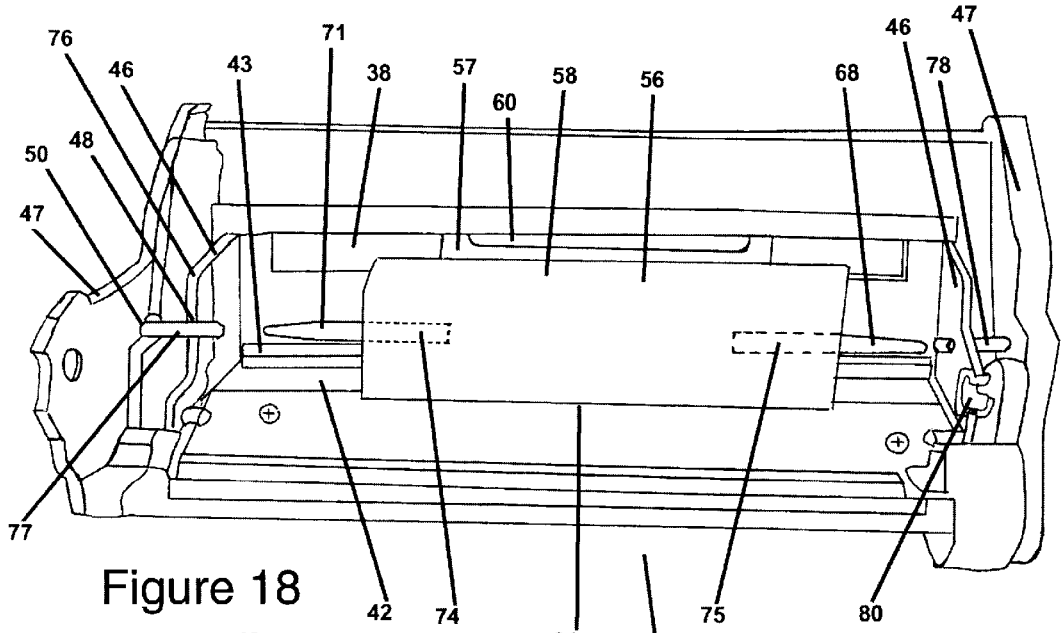
FIG. 18 shows inside of an HP 4000 waste toner hopper with a PinPounder tool inserted in the laser light slot and illustrates how the holding pin may be easily removed with the inner pin mount structure partially cutaway to view the holding pin location.
Figure 19:
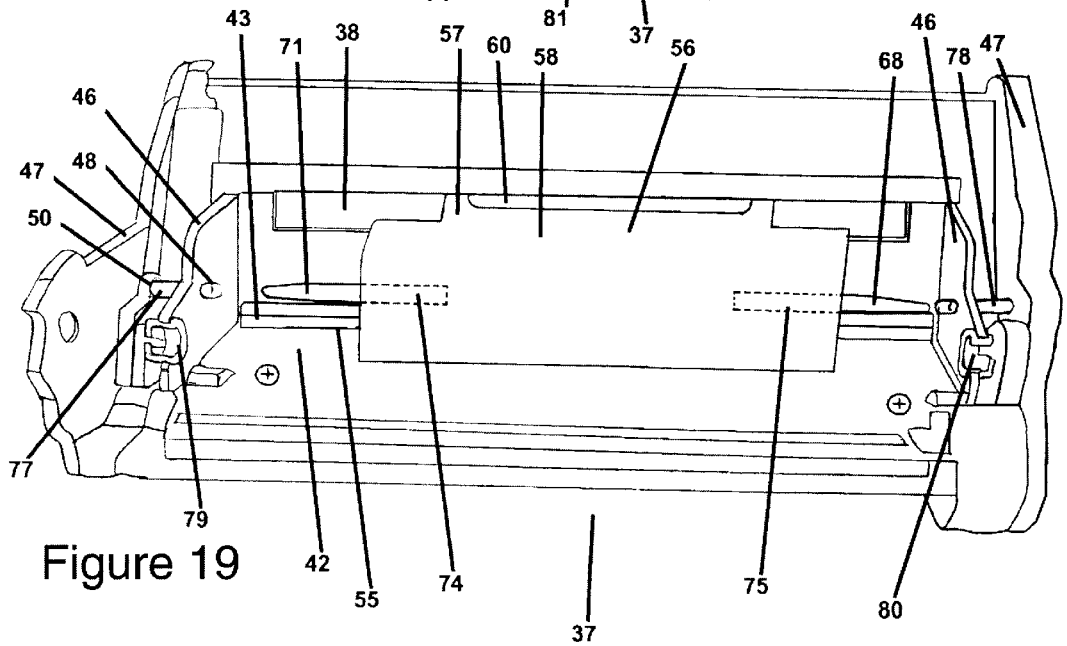
FIG. 19 shows inside of an HP 4000 waste toner hopper with a PinPounder tool inserted in the laser light slot and illustrates how the holding pin may be easily removed.

FIGS. 18 and 19 show how the pinpounder tool 56 operates inside the waste toner hopper 37 to remove the holding pins 77 and 78 which in the HP 4000 are each identical to the holding pin 12 but are designated with different numbers to differentiate left from right. In FIG. 18, the left inner pin mount structure 46 is cutaway 76 so the left holding pin 77 is more visible in the figure whereas in FIG. 19 the inner pin mount 46 is not cutaway. The outer pin mount structures 47 are for the purpose of containing the OEM holding pin 12 depicted as 77 on the left and 78 on the right. The inner mount 46 which also houses the holding pin bore 48 also prevents the holding pin 12 from being pushed all the way through the mount structure 46. This design was made by the OEM to make recycling or remanufacturing of this toner cartridge difficult to enhance the sales of brand new toner cartridges. However, because of the tool 56, remanufacturing of this toner cartridge may be simple now because the holding pins may be easily removed in 4 seconds, thus having a great impact to the benefit of the recycling and remanufacturing industry. For this reason alone, this invention is of great significance to an entire industry especially in light of the fact that the HP 4000 appears destined to become the most popular printer worldwide if it stays on the market for long. This is because the printer is very affordable, the first affordable printer to print 1200 dpi resolution replacing the old standard of 600 dpi, prints fast at 18 pages per minute, is small and lightweight, and has postscript and network features built-in.

Note that the tool's 56 pins 68 and 71 are press fit into a bore 74 and 75 in the tool 56. Optionally they can be glued in or spot welded in place. The pinpounder tool 56 slides in the laser light slot 38 of the waste toner hopper 37 from left to right and right to left to pound out the holding pins 77 and 78. Not only is the laser light slot 38 used as a guide, similar to a guide on a table saw, but also the tool 56 slides in the corner crevice 55 of the metal frame 41 of the wiper blade assembly shown in FIGS. 13–14. The metal frame 41 of the wiper blade assembly is not unlike an angle iron with a corner crevice 55 and a base or bottom 42 at a right angle to the top 43. Thus, even though the operator of the tool 56 is not required to see inside the waste toner hopper 37 while operating the tool 56 to remove the holding pins 77 and 78 (12), the operator can feel the handle 57 of the tool 56 and can control the tool 56 to slide in the groove 55 by feel without seeing inside and by using both the crevice 55 and the laser light slot 38 as guides, the holding pins can accurately be removed with the tool 56 without missing. In fact it takes around 4 seconds to remove the holding pins 77 and 78.

Figure 20:
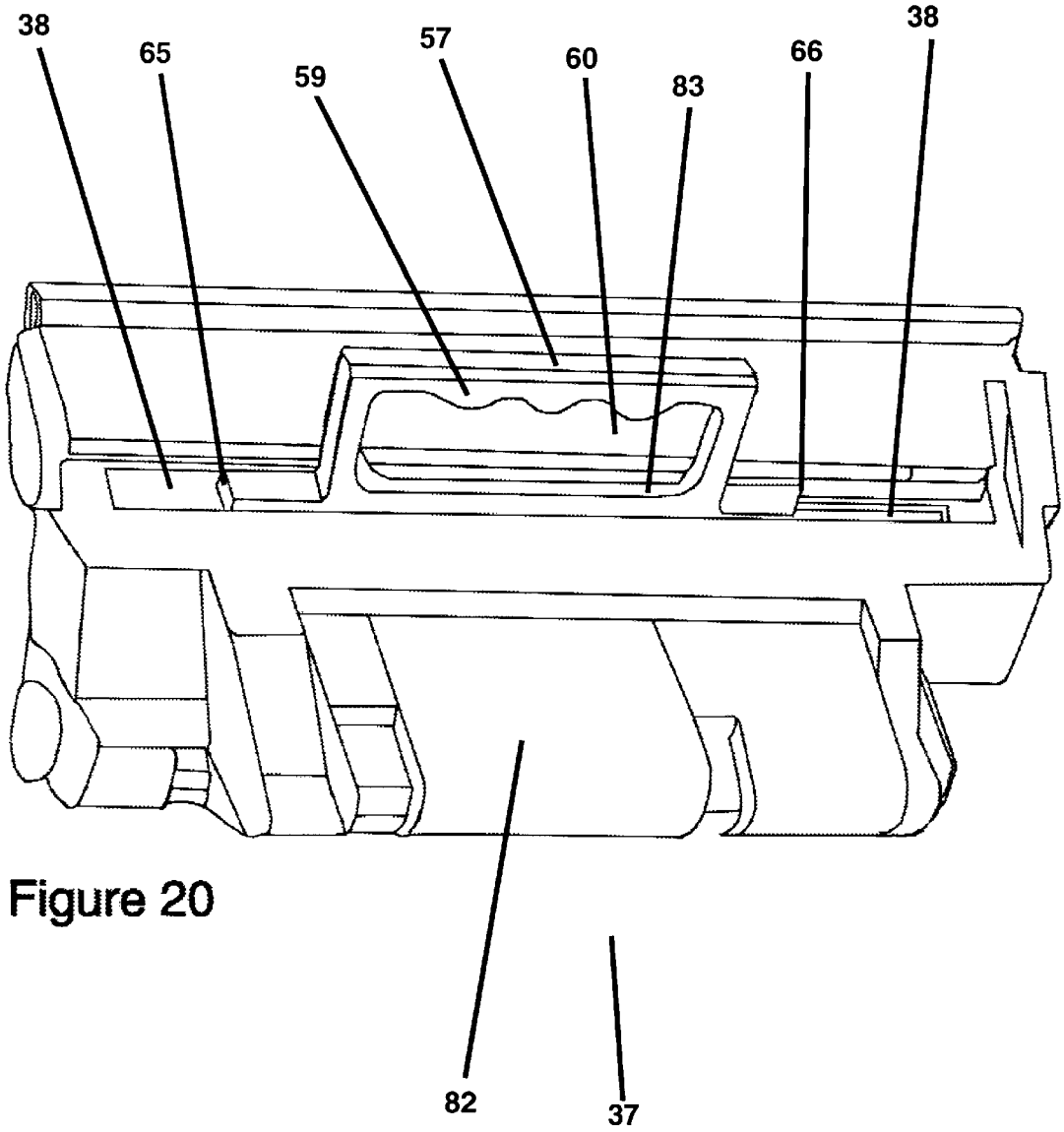
FIG. 20 shows outside of an HP 4000 waste toner hopper with a PinPounder tool inserted in the laser light slot and shows the position of the PinPounder tool.

While FIGS. 18–19 show the inside of the waste toner hopper 37, FIG. 20 shows the outside view of the waste toner hopper 37. One can see how the tool 56 fits through the laser light slot 38. Although the ends 65 and 66 are visible in FIG. 20, as well as the bottom portion 83 of the handle 57, in a preferred embodiment this is not visible, nor is the bottom 83 of the grip handle 57, because the tool 56 is pushed inside and on an angle with respect to the waste toner hopper 37 and part of the handle 57 is actually partially submerged inside the laser light slot 38, although it is not shown in FIG. 20 that way. The tank 82 of the waste toner hopper 37 is shown, where waste toner that is cleaned off the photoreceptor is continuously collected. Please note that the bottom 83 of the handle 57 can vary quite a bit in height, so long as there is an opening 60 that a hand can fit through.

To enhance the PinPounder tool 56, the surface of the tool 56 may be engraved, stamped, printed or silk screened with identifying marks. For example, the tools 56 that I had manufactured lists my company's name and phone number, says "patent pending" identifies the product as "PinPounder" to identify the product's name. Some PinPounder tools 56 have been engraved with "The Enforcer" or "Attitude Adjustment Device", which many of my customers thought was humorous.

The earliest versions of the PinPounder tool 56 did not use the pins 68 and 71 on the ends as seen in the enclosed article I wrote that was published in Imaging News, April 1998 with photos of the earlier tool 56. The tool may be coated with black oxide to make it look good and then have the engraved letters filled in with white paint for a very professional look.

Confusion must be avoided in the claims concerning the word "pin", especially in claims that involve pins 68 and 71. Holding pins such as 6, 12, 15, 22, 31, 77 and 78 will be called "holding pins". Pins such as 68 and 71 will be called "pins".

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A method of securing a toner cartridge together by using holding pins having a recessed tapered head so that the exterior end of its heads are the largest diameter portions of said holding pins' heads and are easy to grab with a pulling tool.

2. A device for removal of holding pins from a toner cartridge said device having a base with two ends, said ends of said base of said device having at least one protruding pin for pounding at least one holding pin, and said device having a handle for gripping said device for hammering at least one holding pin to be removed.

3. A device for removal of holding pins from a toner cartridge as in claim 2, whereby toner cartridge has a waste toner hopper and waste toner hopper has a laser light slot wherein said handle having an opening for hand gripping.

4. A device for removal of holding pins from a toner cartridge as in claim 3, whereby toner cartridge has a waste toner hopper and waste toner hoppeer has a laser light slot wherein said device uses the laser light slot of the waste toner hopper as a guide to insure that any holding-pins will be hit consistently when said device is slid through the laser light slot.

5. A device for removal of holding pins from a toner cartridge as in claim 2, whereby toner cartridge has a waste toner hopper and waste toner hopper has a laser light slot, said device using the laser light slot of the waste toner hopper as a guide to insure that at least one holding pin will be hit consistently in the proper position when said device is slid through the laser light slot.

6. A device for removal of holding pins from a toner cartridge as in claim 2 whereby waste toner hopper has attached a wiper blade having a metal frame and the metal frame has a longitudinal bend that forms a longitudinal crevice, and said device uses the metal frame of the wiper blade in the waste toner hopper as a guide to insure that at least one holding pin will be hit consistently in the proper position when said device is slid along the crevice formed in the wiper blade metal frame.

7. A device for removal of holding pins from a toner cartridge as in claim 6, said device having a bump at each end.

8. A device for removal of holding pins as in claim 2 wherein the angle between said handle and said base is between sixty degrees and one hundred and fifty degrees.

9. An improved holding pin for securing together sections of a toner cartridge assembly for use in imaging machines, said improved holding pin comprising a shank and a head larger in width or diameter than said shank, said head having a taper to provide a recess of said head wheere smaller diameter end of said tapered head abuts against toner cartridge assembly and larger diameter end of said tapered head allows an easy grip for easy remmoval of said improved holding pin.

10. An improved holding pin as in claim 9 wherein said shank has a length and a diameter sized to fit within said assembly and secure said sections together.

11. An improved holding pin as in claim 10 wherein said head is sized such that said head does not interfere with fitting said assembly into said imaging machines.

12. An improved holding pin as in claim 9 wherein said holding pin is made of metal.

13. An improved holding pin as in claim 9 wherein said holding pin is made of plastic.

14. An improved holding pin as in claim 9 wherein the assembly has two ends and said improved holding pin is used at each of the two ends of any assembly to secure the sections of the assembly together.

15. An improved holding pin as in claim 9 whereby said holding pin has a variable diameter head with a taper whereby said head diameter increases as the distance from the toner cartridge increases.

16. An improved holding pin as in claim 15 whereby said head of said holding pin has one said tapered portion with increase in diameter whereby said increase in diameter increases as the distance from the toner cartridge increases and the largest diameter region of said head has a substantially uniform diameter portion.

17. An improved holding pin as in claim 9 whereby said head of said holding pin has an end portion of larger diameter than beginning portion of said head and said end portion of said head is substantially uniform.

18. An improved holding pin for securing together sections of a toner cartridge assembly for use in an image forming apparatus, said improved holding pin comprising a shank, a first head and a second head whereby said first and said second heads are larger in width or diameter than said shank, and a space is formed between said first and said second head to provide a recess of said outermost head providing an easy grip for easy removal of said improved holding pin.

19. A method of removing holding pins from a toner cartridge using a hammer device with at least one pin sticking out of and affixed to one or more of the hammer device ends wherein said method involves using the hammer device to thereby knock at least one holding pin out of the toner cartridge from the inside out so that the toner cartridge can be separated into the toner hopper and the waste toner hopper components.

20. A method of removing holding pins from a toner cartridge as in claim 19 wherein said method includes using either the laser light slot of the toner cartridge as a guide to slide the hammer device for accurately positioning the hammer device or using the crevice of the bent metal frame of the wiper blade located inside the toner cartridge as a guide to slide the hammer device for accurately positioning the hammer device so that the pins of the hammer device will always accurately hit the holding pins of the toner cartridge which hold the toner cartridge components together.

* * * * *